US010780334B2

(12) United States Patent
Nilsson et al.

(10) Patent No.: US 10,780,334 B2
(45) Date of Patent: Sep. 22, 2020

(54) ZIPPERED SAFETY LAYER IN A TRAMPOLINE

(71) Applicant: Avero AB, Gothenburg (SE)

(72) Inventors: Henrik Nilsson, Mullsjö (SE); Thomas Hagel, Uddevalla (SE)

(73) Assignee: Avero AB, Gothenburg (SE)

( * ) Notice: Subject to any disclaimer, the term of this patent is extended or adjusted under 35 U.S.C. 154(b) by 77 days.

(21) Appl. No.: 16/024,769

(22) Filed: Jun. 30, 2018

(65) Prior Publication Data

US 2020/0001162 A1 Jan. 2, 2020

(51) Int. Cl.

| | |
|---|---|
| ***A63B 5/11*** | (2006.01) |
| ***A63B 21/02*** | (2006.01) |
| ***A63B 71/00*** | (2006.01) |

(52) U.S. Cl.

CPC ..... *A63B 71/0054* (2013.01); *A63B 5/11* (2013.01); *A63B 21/023* (2013.01); *A63B 2071/009* (2013.01)

(58) Field of Classification Search

CPC .... A63B 5/00; A63B 5/11; A63B 5/12; A63B 5/16; A63B 5/166; A45C 13/1023; A45C 13/103; A45C 2013/1007

USPC ..... 24/381, 418; 482/27–32; 472/129

See application file for complete search history.

(56) References Cited

U.S. PATENT DOCUMENTS

| | | | | |
|---|---|---|---|---|
| 2,370,990 A | | 3/1945 | Nissen | |
| 3,546,721 A | | 12/1970 | Cleary | |
| 4,433,838 A | | 2/1984 | Gordon | |
| 4,900,011 A | | 2/1990 | Nolet | |
| 5,385,518 A | * | 1/1995 | Turner | A63B 5/11 482/23 |
| 5,399,132 A | | 3/1995 | Bailey | |
| D382,618 S | | 8/1997 | Gift | |
| 5,665,040 A | | 9/1997 | Ho | |
| 5,700,232 A | | 12/1997 | Clausen et al. | |
| 5,776,003 A | | 7/1998 | Kenny | |
| 5,911,535 A | | 6/1999 | Gvolch | |
| 6,053,845 A | | 4/2000 | Publicover et al. | |
| 6,129,649 A | | 10/2000 | Yang | |
| 6,206,811 B1 | | 3/2001 | Lat | |

(Continued)

FOREIGN PATENT DOCUMENTS

| | | |
|---|---|---|
| AU | 2015202862 A1 | 12/2015 |
| AU | 2017200402 A1 | 2/2017 |

(Continued)

OTHER PUBLICATIONS

International search report for PCT/EP2017/057961.

(Continued)

*Primary Examiner* — Loan B Jimenez
*Assistant Examiner* — Zachary T Moore
(74) *Attorney, Agent, or Firm* — AWA Sweden AB; Thomas L. Ewing

(57) ABSTRACT

Embodiments of the invention provide a zipper attached safety layer applied between a flexible mat and an edge pad of a trampoline. The safety layer moves with the flexible mat and prevents a user from accidently inserting an appendage into the suspension system (e.g., coiled springs) of the trampoline. Embodiments of the invention further relate to a trampoline comprising such a zippered safety layer and to a method of arranging the safety layer in a trampoline.

20 Claims, 7 Drawing Sheets

(56) References Cited

U.S. PATENT DOCUMENTS

| | | | | |
|---|---|---|---|---|
| 6,261,207 | B1 | 7/2001 | Publicover | |
| 6,319,174 | B1 | 11/2001 | Alexander | |
| 6,607,468 | B1 | 8/2003 | Nichols, Jr. | |
| 6,672,997 | B1 | 1/2004 | Winkler | |
| 6,676,576 | B1 | 1/2004 | Wu | |
| 6,866,617 | B2 | 3/2005 | Chen | |
| D504,038 | S | 4/2005 | Perella et al. | |
| D536,405 | S | 2/2007 | Freeman | |
| 7,481,740 | B2 | 1/2009 | Colling | |
| 7,678,024 | B2 | 3/2010 | Alexander | |
| 7,708,667 | B2 | 5/2010 | Alexander | |
| 7,758,471 | B2 | 7/2010 | Nelson | |
| 7,850,575 | B1 | 12/2010 | Hsiang | |
| 7,854,687 | B2 | 12/2010 | Alexander | |
| D630,285 | S | 1/2011 | Hsiang | |
| D652,617 | S | 1/2012 | Chen | |
| 8,105,211 | B2 | 1/2012 | Alexander | |
| 8,303,469 | B2 | 11/2012 | Alexander | |
| 8,430,795 | B2 | 4/2013 | Publicover | |
| 8,650,724 | B2 * | 2/2014 | King | A45C 13/103 190/120 |
| 8,764,610 | B2 | 7/2014 | Chen | |
| 8,790,221 | B2 | 7/2014 | Schaffer | |
| RE45,182 | E | 10/2014 | Nelson | |
| 8,905,898 | B2 | 12/2014 | Chen | |
| 8,920,290 | B2 | 12/2014 | Stokes | |
| 9,339,676 | B2 | 5/2016 | Publicover | |
| D759,773 | S | 6/2016 | Miller | |
| 9,486,658 | B2 | 11/2016 | Alexander | |
| 9,545,532 | B2 | 1/2017 | Miller | |
| 9,656,110 | B2 | 5/2017 | Alexander | |
| 9,700,748 | B2 | 7/2017 | Howe | |
| D794,150 | S | 8/2017 | Ji | |
| D794,151 | S | 8/2017 | Ji | |
| 9,873,009 | B2 | 1/2018 | Miller | |
| 2002/0137598 | A1 | 9/2002 | Publicover et al. | |
| 2004/0121883 | A1 | 6/2004 | Publicover | |
| 2005/0032609 | A1 | 2/2005 | Nissen | |
| 2005/0245370 | A1 | 3/2005 | Boland | |
| 2005/0075223 | A1 | 4/2005 | Wu | |
| 2005/0187082 | A1 | 8/2005 | Bowser | |
| 2005/0239618 | A1 | 10/2005 | Teng | |
| 2005/0255976 | A1 | 11/2005 | Hinds et al. | |
| 2006/0025289 | A1 | 2/2006 | Wallach | |
| 2006/0089240 | A1 | 4/2006 | Yu | |
| 2007/0000182 | A1 * | 1/2007 | Boujon | A63B 5/11 52/2.17 |
| 2007/0004560 | A1 | 1/2007 | Nelson | |
| 2008/0009394 | A1 | 1/2008 | Van Elverdinghe | |
| 2009/0111659 | A1 | 4/2009 | Xiang | |
| 2009/0276984 | A1 * | 11/2009 | Rabe | A44B 19/301 24/388 |
| 2011/0256985 | A1 | 10/2011 | Mann | |
| 2014/0069757 | A1 * | 3/2014 | Schlipper | A44B 19/06 190/113 |
| 2014/0221162 | A1 * | 8/2014 | Chen | A63B 43/005 482/27 |
| 2014/0371031 | A1 * | 12/2014 | Allen | A63B 5/11 482/27 |
| 2015/0045188 | A1 * | 2/2015 | Allen | A63B 71/0054 482/27 |
| 2017/0128779 | A1 | 5/2017 | Howe et al. | |
| 2017/0173376 | A1 | 6/2017 | Miller et al. | |
| 2017/0361155 | A1 | 12/2017 | McGrane et al. | |
| 2019/0060692 | A1 * | 2/2019 | Chang | A63B 71/022 |

FOREIGN PATENT DOCUMENTS

| | | | |
|---|---|---|---|
| CA | 2808984 | A1 | 9/2013 |
| CA | 2896049 | A1 | 12/2016 |
| CN | 1277592 | C | 10/2006 |
| CN | 200957263 | Y | 10/2007 |
| CN | 101102821 | A | 1/2008 |
| CN | 101332348 | A | 12/2008 |
| CN | 201848045 | U | 6/2011 |
| CN | 202237001 | U | 5/2012 |
| CN | 202446713 | U | 9/2012 |
| CN | 201147592 | Y | 11/2012 |
| CN | 202666263 | U | 1/2013 |
| CN | 202876183 | U | 4/2013 |
| CN | 302552501 | S | 8/2013 |
| CN | 203525194 | U | 4/2014 |
| CN | 101918085 | A | 5/2014 |
| CN | 103826707 | A | 5/2014 |
| CN | 103889512 | A | 6/2014 |
| CN | 204261253 | U | 4/2015 |
| CN | 105358223 | A | 2/2016 |
| CN | 106507668 | A | 3/2017 |
| CN | 107427709 | A | 12/2017 |
| CN | 206809609 | U | 12/2017 |
| CN | 207342088 | U | 5/2018 |
| DE | 9013998 | U1 | 1/1991 |
| EP | 0265440 | A1 | 5/1988 |
| EP | 1044705 | A1 | 10/2000 |
| JP | 356063465 | U | 5/1981 |
| JP | 359164654 | U | 11/1984 |
| JP | 363146666 | U | 9/1988 |
| SE | 1651023 | A1 | 2/2018 |
| WO | 02087704 | A1 | 11/2002 |
| WO | 2009/098324 | A2 | 8/2009 |
| WO | 2014/058364 | A1 | 4/2014 |
| WO | 2017/174567 | A1 | 10/2017 |

OTHER PUBLICATIONS

International search report for PCT/SE2012/051088.

European search report for EP Application No. 20153446.8, entitled "Trampoline with Corner Support Bar," foreign counterpart of U.S. Appl. No. 16/750,391, filed Jan. 23, 2020, also assigned to Avero AB. Search report dated Jun. 5, 2020.

European search report for EP Application No. 20153445.0, entitled "Silent Performance System and Under Padding Channels in a Trampoline," foreign counterpart of U.S. Appl. No. 16/750,410, filed Jan. 23, 2020, also assigned to Avero AB. Search report dated Jun. 8, 2020.

European search report for EP Application No. 20153447.6, entitled "High-Tension Safety Net in a Trampoline," foreign counterpart of U.S. Appl. No. 16/750,427, filed Jan. 23, 2020, also assigned to Avero AB. Search report dated Jun. 4, 2020.

* cited by examiner

500

600

ZIPPERED SAFETY LAYER IN A TRAMPOLINE

FIELD

Embodiments of the invention relate to a zipper attached safety layer applied between a flexible trampoline mat and the trampoline's edge pad. Embodiments of the invention further relate to a trampoline comprising such a zippered safety layer and to a method of arranging the safety layer in a trampoline.

BACKGROUND

The following description includes information that may be useful in understanding embodiments of the invention. It is not an admission that any of the information provided herein is prior art or relevant to the presently claimed invention, or that any publication specifically or implicitly referenced is prior art.

The modern trampoline era began in the mid-1930s, see, e.g., U.S. Pat. No. 2,370,990 by George Nissen who with Larry Griswold was instrumental in developing the modern trampoline. Even though trampolines were initially developed for competitive or professional purposes, trampolines for recreational use are nowadays popular home entertainment accessories.

A trampoline comprises a flexible mat, a frame, and at least one resilient member. The flexible mat is typically circular, oval, square, or rectangular. The flexible mat may comprise a cloth or net-shaped structure. It may be made of a polymeric material, such as polypropylene. The frame, conventionally made of metal, encompasses the flexible mat and typically has substantially the same shape as the flexible mat. A circular or oval mat is typically surrounded by a circular or oval frame having a larger diameter than the flexible mat, and a square or rectangular mat is typically surrounded by a substantially square or rectangular frame, which however may comprise rounded-off edges.

The flexible mat typically comprises a plurality of attachments distributed along the mat's edge. The attachments are adapted to receive one or more resilient members for retaining the flexible mat under tension, creating a suspension system. The resilient members may comprise a plurality of springs (e.g. helical springs) that connect the edge of the flexible mat to the frame, thereby tensioning the flexible mat. When a person is using the flexible mat, i.e. jumping on it, the springs will extend in length and thereafter strive to return to their resting length. The spring may be attached to a loop, such as a D-shaped or triangle shaped ring, comprised in the flexible mat by means of a hook that attaches to the spring. Thus, the system of loops and D-rings comprise the plurality of attachments for the flexible mat to receive the resilient members.

In some trampoline embodiments, the resilient member may comprise an elastic cord. Normally, the elastic cord is long enough to go back and forth between the edge of the flexible mat and the frame several times. Each portion connecting the flexible mat to the frame then forms a segment, which correspond to a spring in the above example. The elastic cord may be so long, that only one elastic cord is utilized for the whole mat, or a plurality of elastic cords may be used.

The flexible mat is conventionally surrounded by an edge pad, which is adapted to at least partly cover the at least one resilient member and/or the frame. The edge pad helps prevent users from stepping or landing between the resilient members, e.g. when climbing onto the flexible mat. The edge pad may also be arranged to cover the frame, thereby reducing a possible impact with the frame in case of stepping or landing on the frame. The edge pad is often made as a number of segments, the shapes of which are adapted to the frame and the flexible mat. For a circular or oval mat, the segments may therefore be arc-shaped. For a square or rectangular mat, rectangular segments may be used.

While safety has improved in trampolines in recent years, there nevertheless exists a continuous need to improve safety in the trampoline arts, especially where such improvements can be accomplished in a commercially reasonable fashion.

SUMMARY OF THE INVENTION

Embodiments of the invention provide a trampoline, comprising a frame, a flexible mat, and a plurality of resilient members attached to the frame and to the flexible mat, wherein the resilient members receive kinetic energy from a user jumping on the flexible mat, causing the user to be lifted above the surface of the flexible mat. The trampoline also includes an edge pad that rests on an upper surface of the frame and extending to the flexible mat, wherein the edge pad includes a material to absorb shock from a user falling on the edge pad and a safety layer removably attached to at least one of the edge pad and the flexible mat, wherein the safety layer seals off open spaces between the edge pad and the flexible mat to prevent user bodily appendages from engaging a resilient member of the plurality of resilient members.

Embodiments of the invention provide a method for assembling a trampoline that comprises attaching a flexible mat to a frame using a plurality of resilient members, wherein the resilient members receive kinetic energy from a user jumping on the flexible mat, causing the user to be lifted above the surface of the flexible mat. The method further comprises attaching an edge pad resting on an upper surface of the frame and extending to the flexible mat, wherein the edge pad includes a material to absorb shock from a user falling on the edge pad. The method also comprises removably attaching a safety layer to at least one of the edge pad and the flexible mat, wherein the safety layer seals off open spaces between the edge pad and the flexible mat to prevent user bodily appendages from engaging a resilient member of the plurality of resilient members.

BRIEF DESCRIPTION OF THE DRAWINGS

Embodiments of the invention will be further explained by means of non-limiting examples with reference to the appended drawings. Figures provided herein may or may not be provided to scale. The relative dimensions or proportions may vary. It should be noted that the dimensions of some features of the present invention may have been exaggerated for the sake of clarity.

DETAILED DESCRIPTION OF AN EMBODIMENT OF THE INVENTION

Embodiments of the invention provide a safety layer interposed between the flexible trampoline mat and the trampoline's edge pad. The safety layer seals off the flexible mat and edge pad from the user and the user's bodily appendages (e.g., head, foot, fingers, toes, etc.) and has sufficient flexibility to expand and contract as the user jumps up and down on the trampoline. Thus, the safety layer improves overall safety for the trampoline by preventing the user from inserting a bodily appendage (e.g., head, foot, hand) between the flexible mat and edge pad and dangerously engaging with the trampoline's suspension system. The safety layer may be removably attached to either the flexible mat and/or the edge pad using a zipper such that the safety layer may be easily attached and easily removed, according to an embodiment of the invention.

Figure 1:
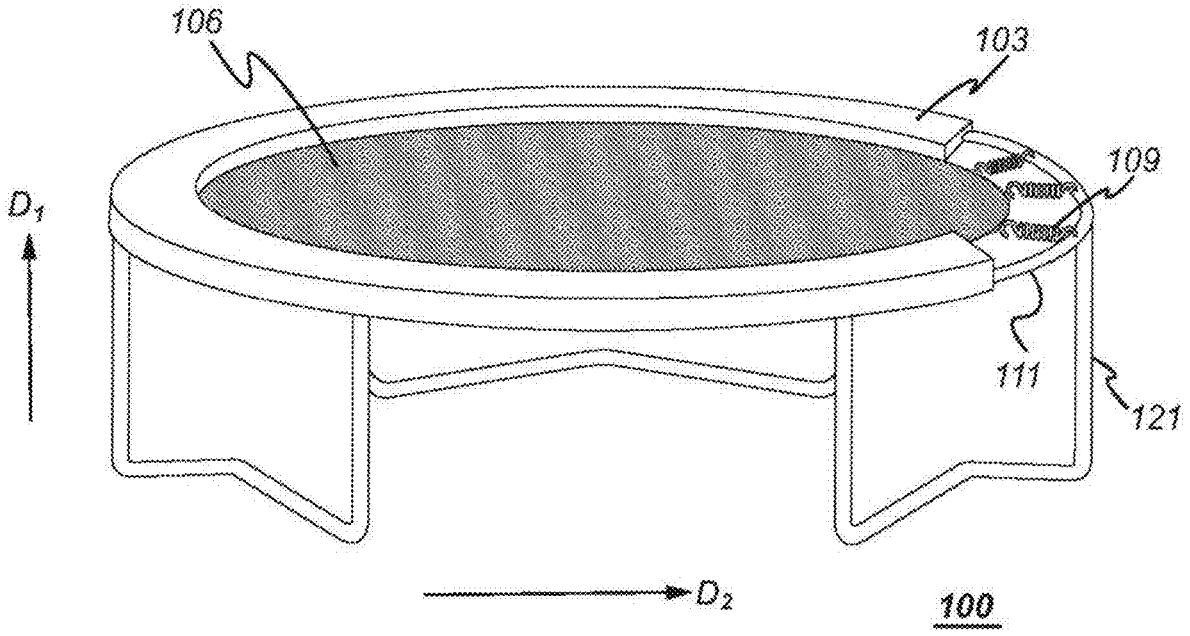
FIG. 1 illustrates a conventional trampoline 100 comprising a flexible mat 106, a frame 111, a plurality of resilient members 109, illustrated as helical springs, and an edge pad 103.

The safety problem solved by the safety layer can be shown by the conventional trampoline depicted in FIG. 1. As shown in FIG. 1, a conventional trampoline 100 comprises a flexible mat 106, a frame 111, a plurality of resilient members 109, illustrated as helical springs, and an edge pad 103. A portion of the edge pad 103 has been removed to show the resilient members 109. The frame 111 is supported by a plurality of legs 121.

The resilient members 109 comprise a suspension system between the flexible mat 106 and the frame 111 for the trampoline 100. Trampoline users jump or bounce on the flexible mat 106 in a vertical direction $D_1$ and possibly also move in a horizontal direction $D_2$ perpendicular to the first direction $D_1$. The edge pad 103 lies on top of the suspension system comprising the resilient members 109 to protect trampoline users from harm as they jump on the flexible mat 106 since they could possibly land on the suspension system and become injured. The fabric of the flexible mat 106 that users jump or bounce on is often not elastic itself, instead the resilient members 109 (e.g., helical springs) provide the elasticity which creates the potential energy. The edge pad 103 generally serves to reduce the severity of impact injuries.

However, a safety problem resides in the design of trampoline 100 because some users, especially children, may accidentally place a bodily appendage (e.g., their feet, head, or hands) between the flexible mat 106 and the edge pad 103 and contact the suspension system comprising the resilient members 109. For example, if a user is bouncing particularly high on the flexible mat 106, causing the resilient members 109 to flex, then a user's bodily appendage (e.g., a hand or foot) landing on the resilient members 109 could cause a painful and harmful pinch to the user's bodily appendage as the resilient members 109 contract while returning to their resting position. Trampoline users tend to increasingly lose control of their bodily motions as they impart increasing amounts of energy to the trampoline's suspension system, thus increasing the chance of an accident such as falling and accidentally slipping a hand or foot into the suspension system.

To prevent user bodily appendages from coming into contact with the resilient members of the suspension system, the edge pad 103 should be attached to the flexible mat 106, according to an embodiment of the invention. These two parts could be sewn or glued together but such a connection would complicate maintenance and transportation of the trampoline. In addition, directly attaching the edge pad 103 to the flexible mat 106 could cause problems as the trampoline user jumps up and down on the flexible mat 106 due to a loss of flexibility between the flexible mat 106 and the edge pad 103. In such situations, the increased strain could cause tearing of one the flexible mat 106, the edge pad 103, and/or the attachment between them.

Accordingly, an embodiment of the invention comprises attaching the edge pad to the flexible using a removably attachable safety layer. The safety layer may expand and contract as the user jumps up and down on the trampoline, avoiding a build-up of excess tension in the edge pad and/or the flexible mat. The removably attachable safety layer may comprise a piece that directly attaches between the flexible mat and the edge pad to prevent the user from accidentally touching the suspension system while providing an appropriately level of flexibility for continued operations of the trampoline.

The safety layer may be removably attached to one or both sides of the flexible mat and edge pad, according to various embodiments of the invention. These embodiments aim to simplify trampoline assembly for end user customers and/or maintenance personnel.

Figure 2A:
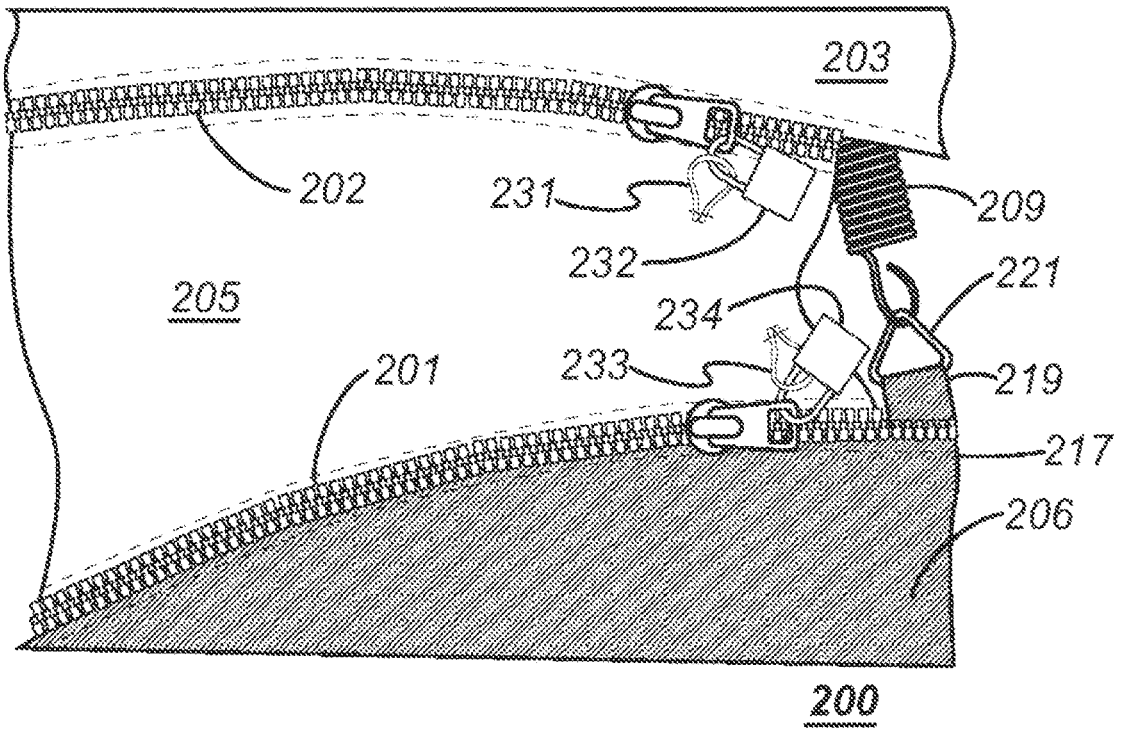
FIGS. 2A and 2B illustrate a safety layer 205 in a trampoline 200, according to an embodiment of the invention.
Figure 2B:
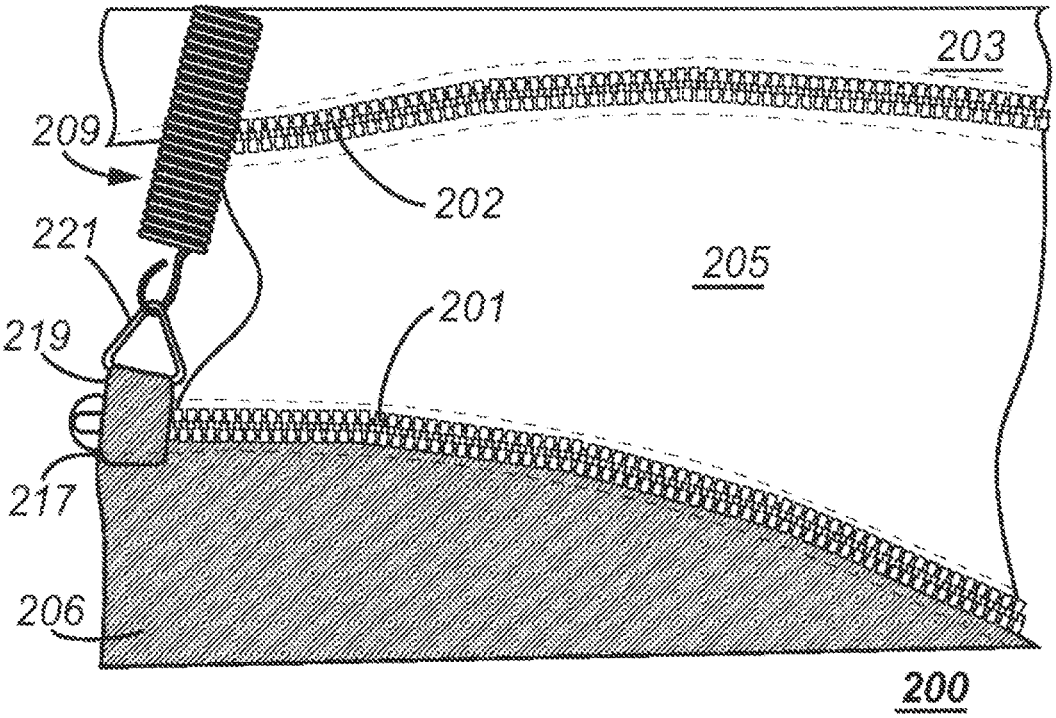
Figure 8:
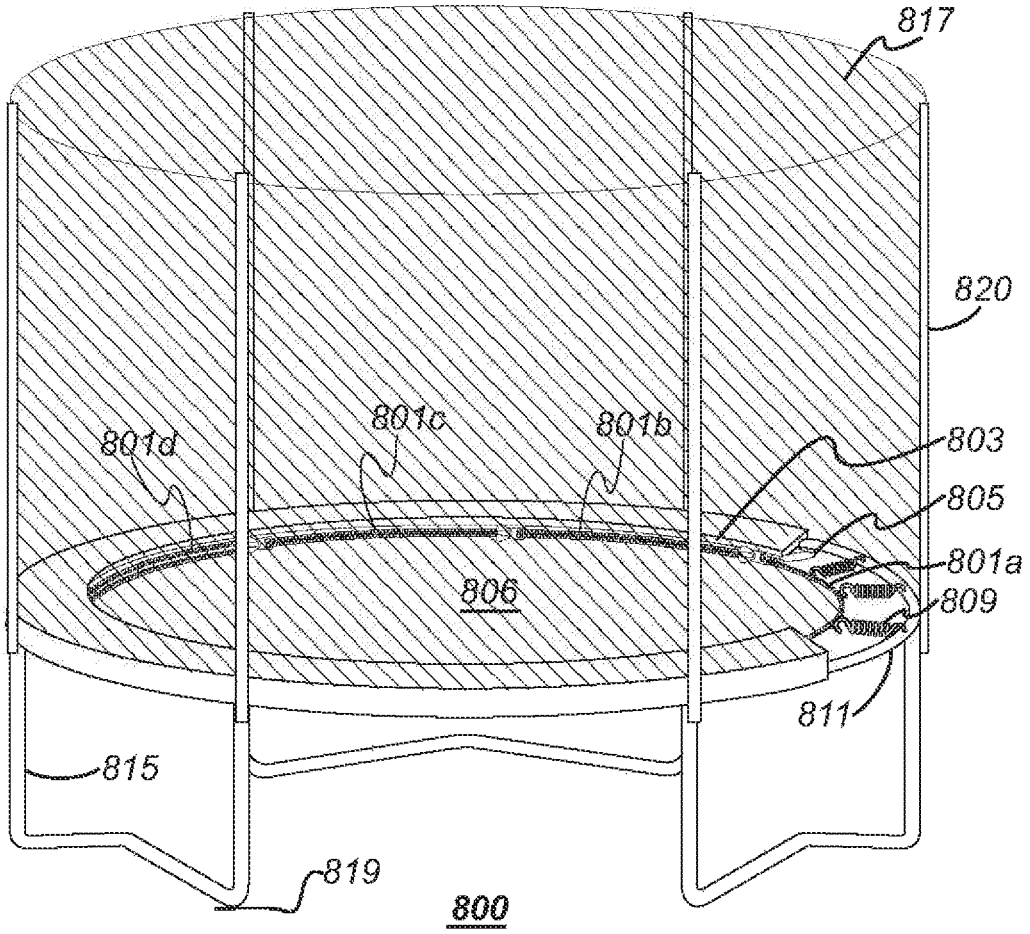
FIG. 8 illustrates a trampoline 800, according to an embodiment of the invention.

FIGS. 2A and 2B illustrate a close-up view of a safety layer 205 in a trampoline 200, according to an embodiment of the invention. (FIG. 8 provides an exemplary embodiment of an entire trampoline 800 suitable for application of a safety layer, such as the safety layer 205). FIG. 2A illustrates the trampoline 200 shown from a top side (e.g., the side that user bounces on) while FIG. 2B illustrates the trampoline 200 shown from a bottom side.

A zipper 201 attaches the safety layer 205 to the flexible mat 206, and a zipper 202 attaches the safety layer 205 to the edge pad 203, according to an embodiment of the invention. The edge pad 203 and the flexible mat 206 have similar functions to the edge pad 103 and the flexible mat 106 shown in FIG. 1. The zipper 201 typically surrounds the flexible mat 206, and the zipper 202 typically surrounds the edge pad 203, according to an embodiment of the invention.

As shown in FIGS. 2A and 2B, the zipper 201 and the zipper 202 have not been pulled completely taught so as to reveal a spring 209 that comprises a resilient member and forms part of the trampoline suspension system shown in FIG. 1. To prevent the zipper 201 and/or the zipper 202 from coming open once closed, the zippers 201, 202 could each be fixed in a closed position with small padlocks whose shanks (or shackles) pass through an opening in the slider on each of the zippers 201, 202. For example, the zipper 201 could be locked with a small padlock 234 that locks the zipper 201 in place to the safety layer 205 via an attachment point 233 (e.g., a loop), according to an embodiment of the invention. Similarly, to prevent the zipper 202 from coming open once closed, the zipper 202 could be locked in place with a small padlock 232 that attaches the zipper 201 to the safety layer 205 via an attachment point 231 (e.g. a loop), according to an embodiment of the invention.

The slider for the zipper 201 and the slider for the zipper 202 could be placed on either the top side or the bottom side of the flexible mat 206, the edge pad 203, and the safety layer 205. As shown in FIG. 2A, the sliders for the zippers 201, 202 are on the top (e.g., the user side) of the trampoline 200, but the sliders for the zippers 201, 202 could alternatively be placed on the bottom side of the trampoline 200, according to embodiment of the invention. The location for the attachment points 231, 233 would likewise adjust depending on the location of the zipper sliders, e.g., if the zipper sliders for the zippers 201, 202 were located on the bottom of the trampoline 200, then the attachment points 231, 233 would be located on the bottom of the trampoline 200, according to an embodiment of the invention.

The zipper 201 and/or the zipper 202 could comprise one or more zipper segments that attach the flexible mat 206 and the edge pad 203 to the safety layer 205, according to an embodiment of the invention. For example, the edge pad 203 could be connected to the safety layer 205 by three zippers (collectively comprising zipper 202), for example, aligned in series along the common edge between the safety layer 205 and the edge pad 203, according to an embodiment of the invention. Such an arrangement might involve lower cost and be simpler to assemble.

The thickness of the flexible mat 206 is typically in the range of 0.2 mm to 1 mm. However, the flexible mat 206 is usually reinforced at its edge, resulting in a higher thickness at the edge of the flexible mat 206. The safety layer 205 is sized accordingly for an appropriate fit with the flexible mat 206.

The safety layer 205 may expand and contract as the user jumps up and down on the trampoline 200, avoiding a build-up of excess tension in the edge pad 203 or the flexible mat 206 that could possible cause harm to either the zipper 202 or the zipper 201.

As previously discussed, the flexible mat 206 is retained in tension by a plurality of resilient members 209 (e.g., a coiled spring), according to an embodiment of the invention. The resilient members 209 are attached at or adjacent to an edge 217 of the flexible mat 206 by attachments 219 that include D-shaped or triangle-shaped rings 221. The attachment 219 permits the at least one resilient member 209 to connect to the flexible mat 206. It is possible to arrange the attachments 219 for the at least one resilient member 209 at the upper side of the flexible mat 206 in the vicinity of the edge 217 or at the underside of the flexible mat 206 in the vicinity of the edge 217 of the flexible mat 206. The attachments 219 shown in FIGS. 2A and 2B attach on the underside of the flexible mat 206, according to an embodiment of the invention.

The edge 217 of the flexible mat 206 also provides a common edge for the zipper 201 to attach to the safety layer 205, according to an embodiment of the invention. The edge pad 203 has a similarly corresponding edge that provides a common edge for the zipper 202 to attach the edge pad 203 to the safety layer 205, according to an embodiment of the invention.

Figure 3:
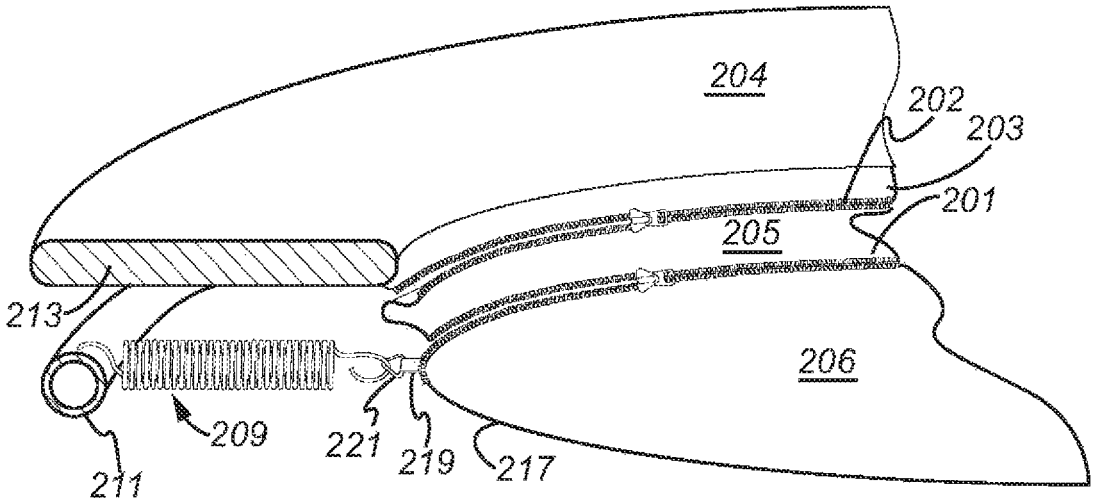
FIG. 3 illustrates the safety layer 205 in a trampoline 200 from another point of view, according to an embodiment of the invention.

FIG. 3 illustrates the safety layer 205 in a trampoline 200 from a cross section point of view and in the context of additional parts of the trampoline 200, according to an embodiment of the invention. As shown in FIG. 3, the safety layer 205 attaches to the flexible mat 206 via zipper 201, and the safety layer 205 attaches to the edge pad 203 via the zipper 202, according to an embodiment of the invention.

As previously discussed, the safety layer 205 may expand and contract as the user jumps up and down on the trampoline 200, avoiding a build-up of excess tension in the edge pad 203 or the flexible mat 206 that could possible cause harm to either the zipper 202 or the zipper 201. The zipper 201 and/or the zipper 202 may comprise one or more zipper segments that attach the flexible mat 206 and the edge pad 203 to the safety layer 205, according to an embodiment of the invention. For example, the edge pad 203 could be connected to the safety layer 205 by three zippers (collectively comprising zipper 202), for example, aligned in series along the common edge between the safety layer 205 and the edge pad 203, according to an embodiment of the invention. Such an arrangement might involve lower cost and be simpler to assemble.

As shown in FIG. 3, the edge pad 203 comprises a covering 204 that has been crimped or folded to facilitate the insertion of a cushioning material 213 into the edge pad 203, according to an embodiment of the invention. The cover 204 may comprise a durable plastic material while the cushioning material 213 may comprise a material such as foam rubber.

The edge pad 203 covers a frame 211 and the trampoline suspension system comprised of at least one resilient member 209 (e.g. a coiled spring). The resilient member 209 (e.g., the spring) shown in FIG. 3, one member of the set of resilient members of the trampoline suspension system, attaches at one end to the frame 211 and at the other end to a D-ring 221 that itself attaches to the flexible mat 206 via attachment 219 in the arrangement discussed above in conjunction with FIGS. 2A and 2B. This arrangement of the suspension system is known in the prior art, such as shown in PCT/EP2017/057961, "Safety Net for a Trampoline, A Trampoline, and a Method of Arranging a Safety Net in a Trampoline," which is hereby incorporated by reference.

Figure 4:
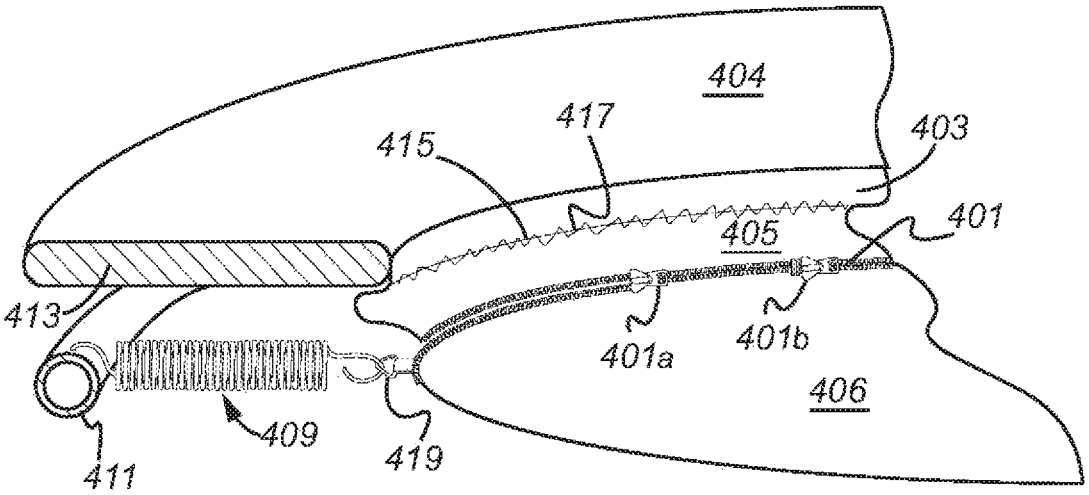
FIG. 4 illustrates a safety layer 405 in a trampoline 400, according to an alternative embodiment of the invention.

FIG. 4 illustrates a safety layer 405 in a trampoline 400, according to an alternative embodiment of the invention. As shown in FIG. 4, the safety layer 405 attaches to the flexible mat 406 via zipper 401, and the safety layer 405 is physically attached to the edge pad 403 along line 415 via a permanent attachment device 417. The zipper 401 typically surrounds the flexible mat 406, according to an embodiment of the invention. The permanent attachment device 417 could comprise sewing, stitching, gluing, stapling, snapping, buttoning or some other attachment means that would securely attaching the edge pad 403 to the safety layer 405 along the line 415. The permanent attachment device 417 is shown in FIG. 4 as stitching that connects the safety layer 405 to the edge pad 403.

The safety layer 405 may expand and contract as the user jumps up and down on the trampoline 400, avoiding a build-up of excess tension in the edge pad 403 or the flexible mat 406 that could possible cause harm to either the zipper 401 or the permanent attachment device 417. The zipper 401 could comprise one or more zipper segments that attach the flexible mat 406 and the safety layer 405, according to an embodiment of the invention. For example, FIG. 4 shows the flexible mat 406 connected to the safety layer 405 by two zippers 401*a*. 401*b* (collectively comprising zipper 401), for example, aligned in series along the common edge between the safety layer 405 and the flexible mat 406, according to an embodiment of the invention. Such an arrangement might involve lower cost and be simpler to assemble.

As shown in FIG. 4, the edge pad 403 comprises a covering 404 that has been crimped or folded to facilitate the insertion of a cushioning material 413 into the edge pad 403, according to an embodiment of the invention. The cover 404 may comprise a durable plastic material while the cushioning material 413 may comprise a material such as foam rubber.

The edge pad 403 covers a frame 411 and the trampoline suspension system (e.g., the resilient member 409). The resilient member 409 (e.g., a coiled spring), one member of the set of resilient members of the trampoline suspension system, attaches at one end to the frame 411 and at the other end to a D-ring 419 that itself attaches to the flexible mat 406 in a manner similar to that disclosed in conjunction with FIG. 3.

Figure 5:
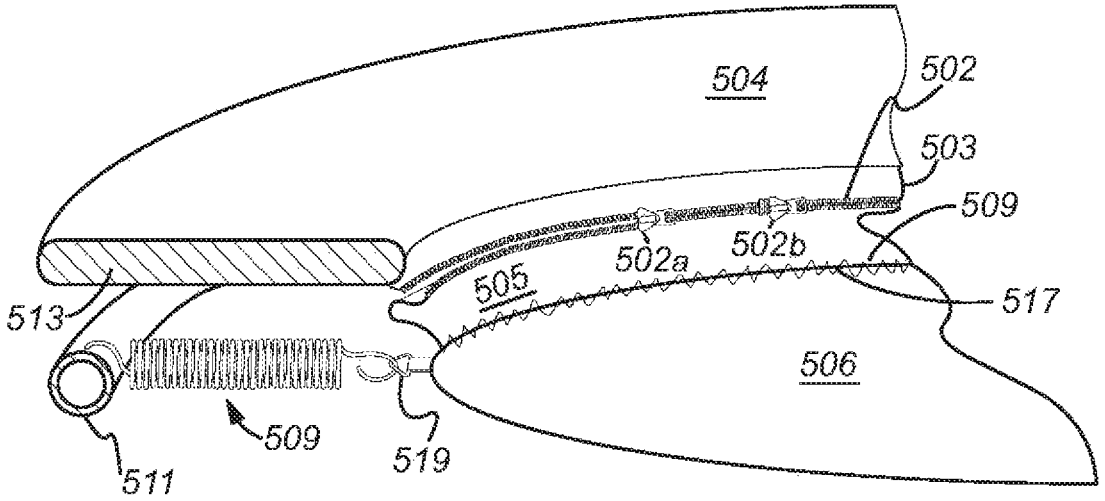
FIG. 5 illustrates a safety layer 505 in a trampoline 500, according to an alternative embodiment of the invention.

FIG. 5 illustrates a safety layer 505 in a trampoline 500, according to an alternative embodiment of the invention. As shown in FIG. 5, the safety layer 505 attaches to the edge pad 503 via zipper 502, and the safety layer 505 is physically attached to the flexible mat 506 along line 509 via a permanent attachment device 517. The zipper 502 typically surrounds the edge pad 503, according to an embodiment of the invention. The permanent attachment device 517 could comprise sewing, stitching, gluing, stapling, snapping, buttoning or some other attachment means that would securely attach the flexible mat 506 to the safety layer 505. The permanent attachment device 517 is shown in FIG. 5 as stitching that connects the safety layer 505 to the flexible mat 506.

The safety layer 505 may expand and contract as the user jumps up and down on the trampoline 500, avoiding a build-up of excess tension in the edge pad 503 or the flexible mat 506 that could possible cause harm to either the zipper 502 or the permanent attachment device 517. The zipper 502 could comprise one or more zipper segments that attach the edge pad 503 to the safety layer 505, according to an embodiment of the invention. For example, FIG. 5 shows the edge pad 503 connected to the safety layer 505 by two zippers 502*a*, 502*b* (collectively comprising zipper 502), for example, aligned in series along the common edge between the safety layer 505 and the edge pad 503, according to an embodiment of the invention. Such an arrangement might involve lower cost and be simpler to assemble.

As shown in FIG. 5, the edge pad 503 comprises a covering 504 that has been crimped or folded to facilitate the insertion of a cushioning material 513 into the edge pad 503, according to an embodiment of the invention. The cover 504 may comprise a durable plastic material while the cushioning material 513 may comprise a material such as foam rubber.

The edge pad 503 covers a frame 511 and the trampoline suspension system comprising a resilient member 509. The resilient member 509 (e.g., a coiled spring), one member of the set of resilient members of the trampoline suspension system, attaches at one end to the frame 511 and at the other end to a D-ring 519 that itself attaches to the flexible mat 506 in a manner similar to that disclosed in conjunction with FIG. 3.

Figure 6:
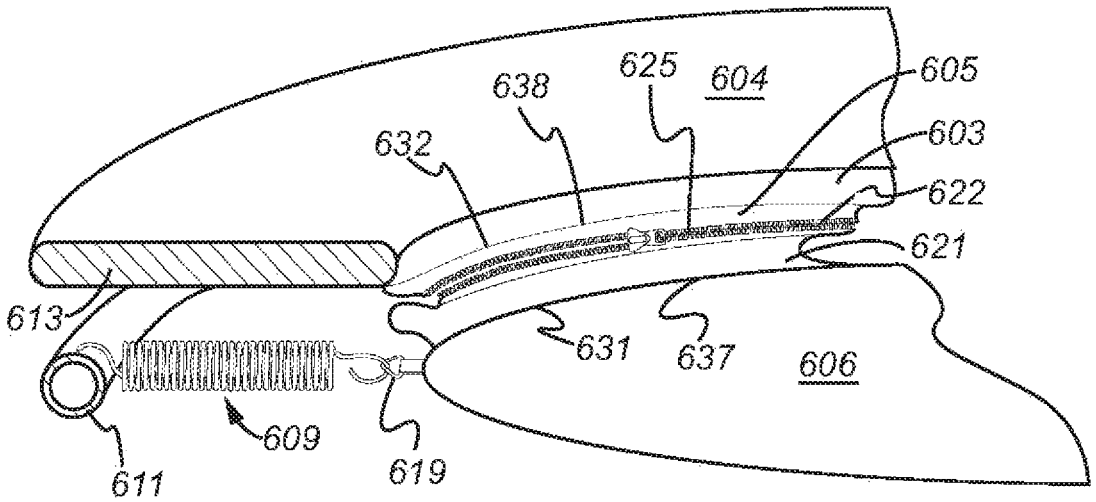
FIG. 6 illustrates a safety layer 605 in a trampoline 600, according to an alternative embodiment of the invention.

FIG. 6 illustrates a safety layer 605 in a trampoline 600, according to an alternative embodiment of the invention. As shown in FIG. 6, the safety layer 605 is divided into a first portion 621 and a second portion 622. The first portion 621 is attached to the second portion 622 via a zipper 625.

An edge of the first portion 621 is physically attached to a flexible mat 606 along line 631 via a permanent attachment device 637. The permanent attachment device 637 could involve sewing, stitching, gluing, stapling, or some other means that would securely attach the flexible mat 606 to the first portion 621, according to an embodiment of the invention.

An edge of the second portion 622 is physically attached to an edge pad 603 along line 632 via a permanent attachment device 638, according to an embodiment of the invention. The permanent attachment device 638 could involve sewing, stitching, gluing, stapling, or some other means that would securely attach the edge pad 603 to the second portion 622.

The safety layer 605 may expand and contract as the user jumps up and down on the trampoline 600, avoiding a build-up of excess tension in the edge pad 603 or the flexible mat 606 that could possible cause harm to either the permanent attachment device 637 or the permanent attachment device 638.

The zipper 625 could comprise one or more zipper segments that attach the first portion 621 of the safety layer 605 to the second portion 622 of the safety layer 605, according to an embodiment of the invention. For example, the first portion 621 could be connected to the second portion 621 by three zippers (collectively comprising zipper 625), according to an embodiment of the invention. Such an arrangement might involve lower cost and be simpler to assemble.

As shown in FIG. 6, the edge pad 603 comprises a covering 604 that has been crimped or folded to facilitate the insertion of a cushioning material 613 into the edge pad 603, according to an embodiment of the invention. The cover 604 may comprise a durable plastic material while the cushioning material 613 may comprise a material such as foam rubber.

The edge pad 603 covers a frame 611 and the trampoline suspension system comprising resilient member 609. The resilient member 609 (e.g., the coiled spring), one member of the set of resilient members of the trampoline suspension system, attaches at one end to the frame 611 and at the other end to a D-ring 619 that itself attaches to the flexible mat 606 in a manner similar to that disclosed in conjunction with FIG. 3.

Figure 7:
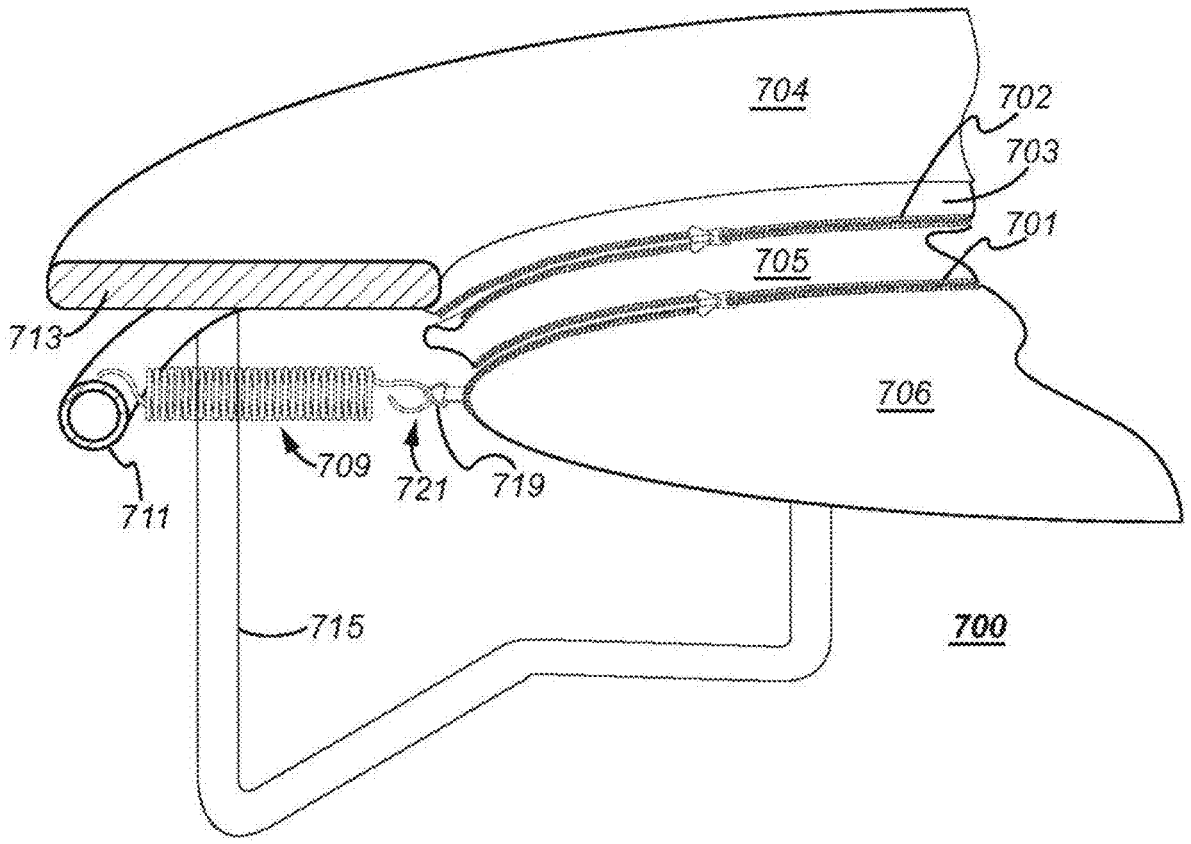
FIG. 7 illustrates a trampoline 700, according an embodiment of the invention.

FIG. 7 illustrates a trampoline 700, according an embodiment of the invention. As shown in FIG. 7, a safety layer 705 attaches to the flexible mat 706 via zipper 701, and the safety layer 705 attaches to the edge pad 703 via the zipper 702, according to an embodiment of the invention. The trampoline 700 resembles the trampoline 300 shown in FIG. 3 but provides additional detail for the overall trampoline 700. The zipper 701 typically surrounds the flexible mat 706, and the zipper 702 typically surrounds the edge pad 703, according to an embodiment of the invention.

The safety layer 705 may expand and contract as the user jumps up and down on the trampoline 700, avoiding a build-up of excess tension in the edge pad 703 or the flexible mat 706 that could possible cause harm to either the zipper 702 or the zipper 701. The zipper 701 and/or the zipper 702 could comprise one or more zipper segments that attach the flexible mat 706 and the edge pad 703 to the safety layer 705, according to an embodiment of the invention. For example, the edge pad 703 could be connected to the safety layer 705 by three zippers (collectively comprising zipper 702), for example, aligned in series along the common edge between the safety layer 705 and the edge pad 703, according to an embodiment of the invention. Such an arrangement might involve lower cost and be simpler to assemble.

As shown in FIG. 7, the edge pad 703 comprises a covering 704 that has been crimped or folded to facilitate the insertion of a cushioning material 713 into the edge pad 703, according to an embodiment of the invention. The cover 704 may comprise a durable plastic material while the cushioning material 713 may comprise a material such as foam rubber.

The edge pad 703 covers a frame 711 and the trampoline suspension system comprising a resilient member 709. The frame 711 is held off the ground by legs 715, according to an embodiment of the invention. The resilient member 709 (e.g., a coiled spring), one member of the set of resilient members of the trampoline suspension system, attaches at one end to the frame 711 and at the other end to a D-ring 719 that itself attaches to the flexible mat 706. The edge of the spring 709 is bent downward 721 and way from the flexible mat 706, according to an embodiment of the invention. This arrangement provides additional user safety since the point of the spring 709 has been bent away from the upper surface of the flexible mat 706. The arrangement of the suspension system is otherwise as shown in FIG. 3.

FIG. 8 illustrates a perspective view of a trampoline 800, according to an embodiment of the invention. The trampoline 800 comprises a flexible mat 806, edge pad 803, and a safety layer 805. In the embodiment shown in FIG. 8, the safety layer 805 is attached to the flexible mat 806 by a zipper 801 (comprised of zipper segments 801*a*-801*d*, as discussed below) and attached to the edge pad 803 via a permanent attachment device such as the permanent attachment device 417 disclosed in FIG. 4. The zipper 801 typically surrounds the flexible mat 806, according to an embodiment of the invention.

The safety layer 805 shown in FIG. 8 is folded under the edge pad 803 as the safety layer 805 would appear in a resting position, such as when the user is not bouncing on the trampoline 800 and the flexible mat 806 is not depressed by the user jumping on the flexible mat 806. When the user is bouncing on the flexible mat 806, then the safety layer 805 extends in a manner similar to the depiction of the safety layer 205 shown in FIG. 3, the safety layer 405 shown in FIG. 4, the safety layer 505 shown in FIG. 5, the safety layer 605 shown in FIG. 6, and the safety layer 705 shown in FIG. 7. If the user bounces high enough on the trampoline 800, then the folds in the safety layer 805 straighten out and the material of the safety layer 805 may even stretch, according to an embodiment of the invention.

The zipper 801 comprises a plurality of zipper segments 801*a*-801*d* that attach the flexible mat 806 to the safety layer 805, according to an embodiment of the invention. For example, the flexible mat 806 could be connected to the safety layer 805 by four zippers 801*a*-801*d* (that collectively comprise the zipper 801), aligned in series along the common edge between the safety layer 805 and the flexible mat 806, according to an embodiment of the invention. Such an arrangement might involve lower cost and be simpler to assemble. The number of zipper segments used would depend upon factors such as zipper cost and efficiency goals related to the ease of assembly. The zippers 801*a*-801*d* typically surround the mat 806, according to an embodiment of the invention.

The safety layer 805 could alternatively be attached to the flexible mat 806 by a permanent attachment device, such as the permanent attachment device 517 disclosed in FIG. 5. The safety layer 805 could also alternatively be attached to the edge pad 803 via a zipper, such as the zipper 502 shown in FIG. 5. Thus, the safety layer 805 in trampoline 800 could employ one zipper (or a combination of zipper segments) or two zippers (or a combination of zipper segments) in a manner disclosed in FIGS. 3-6, according to various embodiments of the invention.

The safety layer 805 may expand and contract as the user jumps up and down on the trampoline 800, avoiding a build-up of excess tension in the edge pad 803 or the flexible mat 806 that could possible cause harm to either the permanent attachment device 817 or the zipper 801.

The flexible mat 806 is encompassed by the frame 811. The frame 811 comprises legs 815, such that the trampoline 800 stands on the ground 819 via the legs 815. The edge pad 803 covers the resilient members 809 (e.g., a coiled spring) and the frame 811. FIG. 8 shows the resilient member 809 in a cutaway of the edge pad 803. The resilient members 809 surround the flexible mat 806 and attach to the frame 811. The edge pad 803 would normally provide a complete covering without the cutaway portion shown in FIG. 8. In the illustrated embodiment, the flexible mat 806 and the surrounding frame 811 are shown as circular, but they may also be e.g. oval, square, or rectangular.

The trampoline 800 includes a safety net 817 attached to a number of safety poles 820. The safety net 817 attaches to the outside edge of the edge pad 803, according to an embodiment of the invention. The safety net 817 and safety poles 820 may be configured in a manner such as disclosed in the applicants' PCT/EP2017/057961 and/or as disclosed in applicants' pending EP18154158.2 application. Both applications are incorporated herein by reference.

The safety net 817 prevents a user from falling off the flexible mat 806 and hitting the ground 819. The safety net 817 may be retained by a safety net retainer, e.g. a number of support poles 820 extending upwardly from the frame 811 for carrying the safety net 817 surrounding the flexible mat 806, according to an embodiment of the invention.

Figure 9:
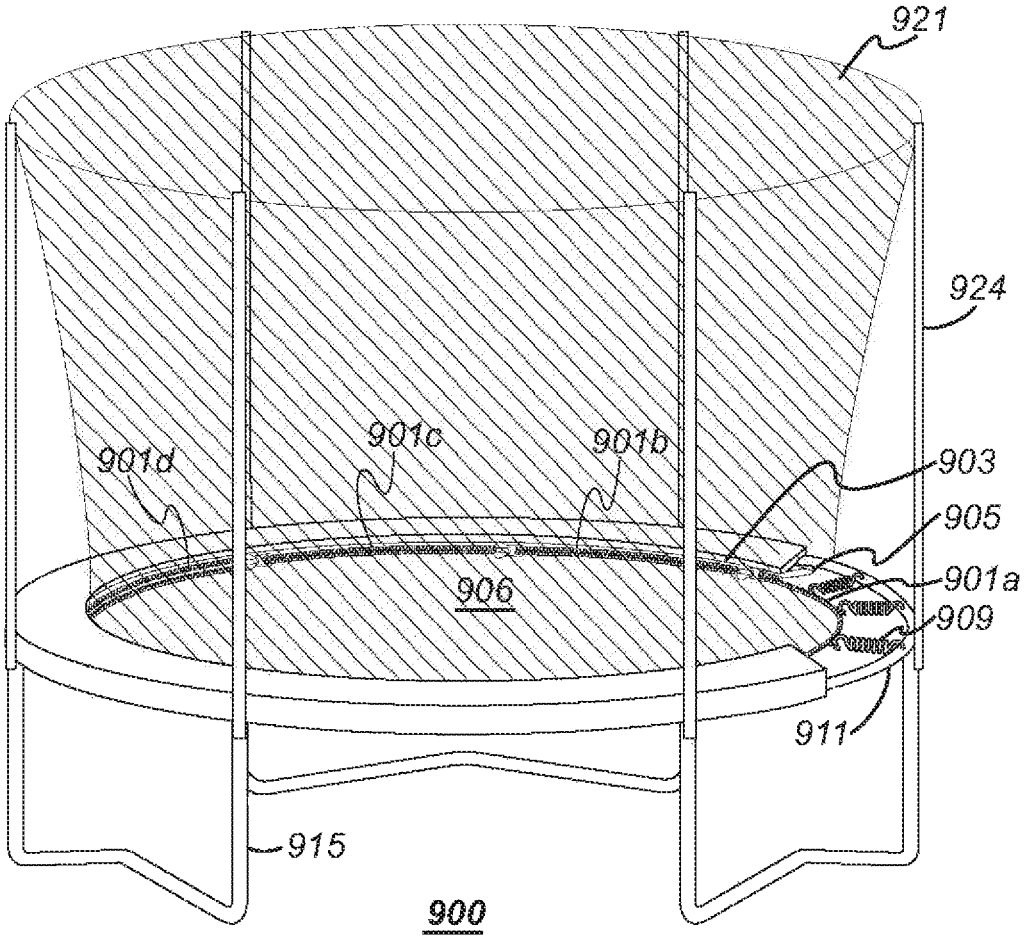
FIG. 9 illustrates a trampoline 900, according to an embodiment of the invention.

FIG. 9 illustrates a trampoline 900, according to an embodiment of the invention. The trampoline 900 comprises a flexible mat 906, edge pad 903, and a safety layer 905. In the embodiment shown in FIG. 9, the safety layer 905 is attached to the flexible mat 906 by a zipper 901 (comprised of zipper segments 901*a*-901*d*, as described below) and attached to the edge pad 903 via a permanent attachment device such as the permanent attachment device 417 disclosed in FIG. 4. The zipper 901 typically surrounds the flexible mat 906, according to an embodiment of the invention.

The safety layer 905 shown in FIG. 9 is folded under the edge pad 903 as the safety layer 905 would appear in a resting position, such as when the user is not bouncing on the trampoline 900 and the flexible mat 906 is not depressed by the user jumping on the flexible mat 906. When the user is bouncing on the flexible mat 906, then the safety layer 905 extends in a manner similar to the depiction of the safety layer 205 shown in FIG. 3, the safety layer 405 shown in FIG. 4, the safety layer 505 shown in FIG. 5, the safety layer 605 shown in FIG. 6, and the safety layer 705 shown in FIG. 7. If the user bounces high enough on the trampoline 900, then the folds in the safety layer 905 straighten out and the material of the safety layer 905 may even stretch, according to an embodiment of the invention.

The zipper 901 comprises a plurality of zipper segments 901*a*-901*d* that attach the flexible mat 906 to the safety layer 905, according to an embodiment of the invention. For example, the flexible mat 906 could be connected to the safety layer 905 by four zippers 901*a*-901*d* (that collectively comprise the zipper 901), aligned in series along the common edge between the safety layer 905 and the flexible mat 906, according to an embodiment of the invention. Such an arrangement might involve lower cost and be simpler to assemble. The number of zipper segments used would depend upon factors such as zipper cost and efficiency goals related to the ease of assembly. The zippers 901*a*-901*d* typically surround the mat 906, according to an embodiment of the invention.

The safety layer 905 could alternatively be attached to the flexible mat 906 by a permanent attachment device, such as the permanent attachment device 517 disclosed in FIG. 5. The safety layer 905 could alternatively be attached to the edge pad 903 via a zipper, such as the zipper 502 shown in FIG. 5. Thus, the safety layer 905 in trampoline 900 could employ one zipper (or a combination of zipper segments) or two zippers (or a combination of zipper segments) in a manner disclosed in FIGS. 3-6, according to an embodiment of the invention.

The flexible mat 906 is encompassed by the frame 911. The frame 911 comprises legs 915, such that the trampoline 900 stands on the ground via the legs 915. The edge pad 903 covers the resilient members 909 (e.g., a coiled spring) and the frame 911. FIG. 9 shows the resilient member 909 in a cutaway of the edge pad 903. The resilient members 909 surround the flexible mat 906 and attach to the frame 911. The edge pad 903 would normally provide a complete covering without the cutaway portion shown in FIG. 9. In the illustrated embodiment, the flexible mat 906 and the surrounding frame 911 are shown as circular, but they may also be e.g. oval, square, or rectangular.

The safety layer 905 may expand and contract as the user jumps up and down on the trampoline 900, avoiding a build-up of excess tension in the edge pad 903 or the flexible mat 906 that could possible cause harm to the zipper 901.

The trampoline includes a safety net 921 attached to a number of safety poles 924. The safety net 921 attaches to the inside edge of the edge pad 903, according to an embodiment of the invention. The safety net 921 and safety poles 924 may be configured in a manner such as disclosed in the applicants' PCT/EP2017/057961 and/or as disclosed in applicants' pending EP18154158.2 application. Both applications are incorporated herein by reference.

The safety net 921 may be attached to the flexible mat 906. Such an attachment helps to prevent the user from stepping on or between the resilient members 909. However, even when using the safety net 921 attached to the flexible mat 906 in a conventional manner, there is still a risk that a foot or an arm of the user (e.g. if landing unfortunately in the vicinity of the edge pad 903 or the flexible mat 906) could slip out between the flexible mat 906 and the safety net 921, e.g. in the interspace between two attachments of the resilient member to the flexible mat. If this would occur, there is a risk of discomfort and even injury to the user of the trampoline 900.

In order to reduce this risk, one could sew the safety net 921 to the flexible mat 906 in the vicinity of the edge of the flexible mat 906. However, sewing is costly and cumbersome, especially since the pieces would typically be sewn after the trampoline has been mounted in order for the sewing to be made over the attached resilient members.

Embodiments of the invention may comprise a kit that is provided to the user in the form of a series of parts, such as a flexible mat, an edge pad, a frame (possibly in a number of pieces), a plurality of resilient members, and a safety layer. Instructions for assembling a trampoline comprising these parts can be provided to the user. Having at least one zippered attachment on the safety layer should shorten the user's assembly time, especially in comparison with an alternative such as sewing or stitching one side of the safety layer to either the edge pad or the flexible mat. In embodiments where the safety layer does not comprise two zippers, the non-zippered side of the safety layer would typically be attached to either the edge pad or the flexible mat in the factory.

The trampolines described herein, such as but not limited to the trampoline 800 shown in FIG. 8 and the trampoline 900 shown in FIG. 9 are amenable to assembly, particularly assembly outside of the factory where they were made such as by a user or a delivery person. The assembly can typically be accomplished by hand or with a minimum number of tools, according to an embodiment of the invention. The legs (e.g., the legs 815 shown in FIG. 8) are typically attached to the frame (e.g., the frame 811. The resilient members (e.g., the resilient members 809) may be next attached to the fame, e.g., the frame 811. The edge pad, e.g., the edge pad 803 may be next placed on top of the frame 811 and the resilient members. The safety layer 805 may be next attached to the edge pad 803 and the flexible mat 806, such as by attached a zipper. The safety poles 820 may be next attached to the frame, and the safety net 817 may be next attached. In some embodiments, the safety net 817 may need to be attached or placed between the flexible mat 806 and the resilient members 809 prior to the connection of the flexible may 806 and the resilient members 809, according to an embodiment of the invention.

Further modifications of the invention within the scope of the appended claims are feasible. As such, the present invention should not be considered as limited by the embodiments and figures described herein. Rather, the full scope of the invention should be determined by the appended claims, with reference to the description and drawings.

Various embodiments of the invention have been described in detail with reference to the accompanying drawings. References made to particular examples and implementations are for illustrative purposes, and are not intended to limit the scope of the invention or the claims.

It should be apparent to those skilled in the art that many more modifications of the trampoline besides those already described are possible without departing from the inventive concepts herein. The inventive subject matter, therefore, is not to be restricted except by the scope of the appended claims. Moreover, in interpreting both the specification and the claims, all terms should be interpreted in the broadest possible manner consistent with the context.

Headings and sub-headings provided herein have been provided as an assistance to the reader and are not meant to limit the scope of the invention disclosed herein. Headings and sub-headings are not intended to be the sole or exclusive location for the discussion of a particular topic.

While specific embodiments of the invention have been illustrated and described, it will be clear that the invention is not limited to these embodiments only. Embodiments of the invention discussed herein may have generally implied the use of materials from certain named equipment manufacturers; however, the invention may be adapted for use with equipment from other sources and manufacturers. Equipment used in conjunction with the invention may be configured to operate according to conventional methods and protocols and/or may be configured to operate according to specialized protocols. Numerous modifications, changes, variations, substitutions and equivalents will be apparent to those skilled in the art without departing from the spirit and scope of the invention as described in the claims. In general, in the following claims, the terms used should not be construed to limit the invention to the specific embodiments disclosed in the specification, but should be construed to include all systems and methods that operate under the claims set forth hereinbelow. Thus, it is intended that the invention covers the modifications and variations of this invention provided they come within the scope of the appended claims and their equivalents.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

We claim:

1. A trampoline, comprising:

a frame;

a flexible mat;

a plurality of resilient members attached to the frame and to the flexible mat, wherein the resilient members receive kinetic energy from a user jumping on the flexible mat, causing the user to be lifted above the surface of the flexible mat;

an edge pad resting on an upper surface of the frame and extending to the flexible mat, wherein the edge pad includes a material to absorb shock from a user falling on the edge pad;

a safety layer attached to the edge pad and the flexible mat, wherein the safety layer seals off open spaces between the edge pad and the flexible mat to prevent user bodily appendages from engaging a resilient member of the plurality of resilient members, wherein the safety layer prevents excess tension in the edge pad and the flexible mat by expanding and contracting as the user jumps on the flexible mat;

a first zipper that removably attaches the safety layer to the flexible mat, wherein the first zipper comprises two rows of interlocking teeth, wherein a first row of the two rows of interlocking teeth is attached to the safety layer and wherein a second row of the two rows of interlocking teeth is attached to the flexible mat; and a second zipper that removably attaches the safety layer to the flexible mat, wherein the second zipper comprises two rows of interlocking teeth, wherein a first row of the two rows of interlocking teeth of the second zipper is attached to the safety layer and wherein a second row of the two rows of interlocking teeth of the second zipper is attached to the flexible mat, wherein the first zipper and the second zipper are aligned in series along an edge of the safety layer and an edge of the flexible mat.

2. The trampoline of claim 1, wherein a slider of the first zipper is held to the safety layer and the flexible mat by a lock.

3. The trampoline of claim 1, wherein the safety layer is attached to the edge pad by stitching.

4. The trampoline of claim 1, wherein the safety layer comprises a stretchable material that expands and contracts as the user jumps on the flexible mat.

5. A trampoline, comprising:

a frame;

a flexible mat;

a plurality of resilient members attached to the frame and to the flexible mat, wherein the resilient members receive kinetic energy from a user jumping on the flexible mat, causing the user to be lifted above the surface of the flexible mat;

an edge pad resting on an upper surface of the frame and extending to the flexible mat, wherein the edge pad includes a material to absorb shock from a user falling on the edge pad;

a safety layer attached to the edge pad and the flexible mat, wherein the safety layer seals off open spaces between the edge pad and the flexible mat to prevent user bodily appendages from engaging a resilient member of the plurality of resilient members, wherein the safety layer prevents excess tension in the edge pad and the flexible mat by expanding and contracting as the user jumps on the flexible mat; and a first zipper that removably attaches the safety layer to the edge pad, wherein the first zipper comprises two rows of interlocking teeth, wherein a first row of the two rows of interlocking teeth is attached to the safety layer and wherein a second row of the two rows of interlocking teeth is attached to the edge pad.

6. The trampoline of claim 5, further comprising a second zipper that removably attaches the safety layer to the edge pad, wherein the second zipper comprises two rows of interlocking teeth, wherein a first row of the two rows of interlocking teeth of the second zipper is attached to the safety layer and wherein a second row of the two rows of interlocking teeth of the second zipper is attached to the edge pad, wherein the first zipper and the second zipper are aligned in series along an edge of the safety layer and an edge of the edge pad.

7. The trampoline of claim 5, wherein a slider of the first zipper is held to the safety layer and the edge pad by a lock.

8. The trampoline of claim 5, wherein the safety layer is attached to the flexible mat by stitching.

9. The trampoline of claim 5, wherein the safety layer comprises a stretchable material that expands and contracts as the user jumps on the flexible mat.

10. A trampoline, comprising:

a frame;

a flexible mat;

a plurality of resilient members attached to the frame and to the flexible mat, wherein the resilient members receive kinetic energy from a user jumping on the flexible mat, causing the user to be lifted above the surface of the flexible mat;

an edge pad resting on an upper surface of the frame and extending to the flexible mat, wherein the edge pad includes a material to absorb shock from a user falling on the edge pad;

a safety layer attached to the edge pad and the flexible mat, wherein the safety layer seals off open spaces between the edge pad and the flexible mat to prevent user bodily appendages from engaging a resilient member of the plurality of resilient members, wherein the safety layer prevents excess tension in the edge pad and the flexible mat by expanding and contracting as the user jumps on the flexible mat;

wherein the safety layer includes a first zipper that removably attaches the safety layer to the flexible mat and a second zipper that removably attaches the safety layer to the edge pad, wherein the first zipper comprises two rows of interlocking teeth, wherein a first row of the two rows of interlocking teeth of the first zipper is attached to the safety layer and wherein a second row of the two rows of interlocking teeth of the first zipper is attached to the flexible mat, wherein the second zipper comprises two rows of interlocking teeth, wherein a first row of the two rows of interlocking teeth of the second zipper is attached to the safety layer and wherein a second row of the two rows of interlocking teeth of the second zipper is attached to the edge pad.

11. The trampoline of claim 10, wherein the trampoline further comprises:

a safety net attached to the edge pad, wherein the safety net prevents the user from falling outside the trampoline during use.

12. The trampoline of claim 10, wherein the edge pad is filled with a foam material.

13. The trampoline of claim 10, wherein the safety layer comprises a stretchable material that expands and contracts as the user jumps on the flexible mat.

14. The trampoline of claim 10, wherein a slider of the first zipper is held to the safety layer and the flexible mat by a lock.

15. The trampoline of claim 10, wherein a slider of the second zipper is held to the safety layer and the edge pad by a lock.

16. A method for assembling a trampoline, comprising:

attaching a flexible mat to a frame using a plurality of resilient members, wherein the resilient members receive kinetic energy from a user jumping on the flexible mat, causing the user to be lifted above the surface of the flexible mat;

positioning an edge pad on an upper surface of the frame and extending the edge pad to the flexible mat, wherein the edge pad includes a material to absorb shock from a user falling on the edge pad; and attaching a safety layer to the edge pad and the flexible mat, wherein the safety layer seals off open spaces between the edge pad and the flexible mat to prevent user bodily appendages from engaging a resilient member of the plurality of resilient members, wherein the safety layer prevents excess tension in the edge pad and the flexible mat by expanding and contracting as the user jumps on the flexible mat, wherein a first zipper removably attaches the safety layer to the edge pad, wherein the first zipper comprises two rows of interlocking teeth, wherein a first row of the two rows of interlocking teeth is attached to the safety layer and wherein a second row of the two rows of interlocking teeth is attached to the edge pad, the method further comprising:

zipping together the first row of the two rows of interlocking teeth and the second row of the two rows of interlocking teeth.

17. The method of claim 16 wherein the safety layer includes a second zipper that removably attaches the safety layer to the flexible mat, wherein the second zipper comprises two rows of interlocking teeth, wherein a first row of the two rows of interlocking teeth is attached to the safety layer and wherein a second row of the two rows of interlocking teeth is attached to the flexible mat, the method further comprising:

zipping together the first row of the two rows of interlocking teeth of the second zipper and the second row of the two rows of interlocking teeth of the second zipper.

18. The method of claim 17 further comprising a third zipper that removably attaches the safety layer to the flexible mat, wherein the third zipper comprises two rows of interlocking teeth, wherein a first row of the two rows of interlocking teeth of the third zipper is attached to the safety layer and wherein a second row of the two rows of interlocking teeth of the third zipper is attached to the flexible mat, the method further comprising:

zipping together the first row of the two rows of interlocking teeth of the third zipper and the second row of the two rows of interlocking teeth of the third zipper, wherein the second zipper and the third zipper are aligned in series along an edge of the safety layer and an edge of the flexible mat.

19. The method of claim 16, further comprising:

attaching the safety layer to the flexible mat by stitching.

20. The method of claim 16, further comprising a second zipper that removably attaches the safety layer to the edge pad, wherein the second zipper comprises two rows of interlocking teeth, wherein a first row of the two rows of interlocking teeth of the second zipper is attached to the safety layer and wherein a second row of the two rows of interlocking teeth of the second zipper is attached to the edge pad, the method further comprising:

zipping together the first row of the two rows of interlocking teeth of the second zipper and the second row of the two rows of interlocking teeth of the second zipper, wherein the first zipper and the second zipper are aligned in series along an edge of the safety layer and an edge of the edge pad.

* * * * *